US011002155B2

(12) United States Patent
Feng

(10) Patent No.: US 11,002,155 B2
(45) Date of Patent: May 11, 2021

(54) PIPELINE CONNECTION SYSTEM FOR STEAM TURBINE AND BOILER COMBINATION

(71) Applicant: Yucheng Feng, Shanghai (CN)

(72) Inventor: Yucheng Feng, Shanghai (CN)

(73) Assignee: Yucheng Feng, Shanghai (CN)

( * ) Notice: Subject to any disclaimer, the term of this patent is extended or adjusted under 35 U.S.C. 154(b) by 0 days.

(21) Appl. No.: 16/607,010

(22) PCT Filed: Apr. 18, 2018

(86) PCT No.: PCT/CN2018/083563
§ 371 (c)(1),
(2) Date: Oct. 21, 2019

(87) PCT Pub. No.: WO2018/192526
PCT Pub. Date: Oct. 25, 2018

(65) Prior Publication Data

US 2020/0131941 A1 Apr. 30, 2020

(30) Foreign Application Priority Data

Apr. 22, 2017 (CN) ..... 201710268345.9

(51) Int. Cl.
*F01K 11/02* (2006.01)
*F01K 13/00* (2006.01)

(52) U.S. Cl.
CPC ..... *F01K 11/02* (2013.01); *F01K 13/006* (2013.01)

(58) Field of Classification Search
CPC ..... F01K 11/02; F01K 13/006; F22B 37/22; F22B 21/40
(Continued)

(56) References Cited

U.S. PATENT DOCUMENTS 3,147,742 A * 9/1964 May ..... F22B 1/1869 122/7 R
3,602,201 A * 8/1971 Baillie ..... F22G 7/14 122/478
(Continued)

FOREIGN PATENT DOCUMENTS

CN 201037429 Y 3/2008
CN 207145025 U 3/2008
(Continued)

OTHER PUBLICATIONS

International Search Report for Application No. PCT/CN2018/083563, dated Jun. 27, 2018, 4 pages.

*Primary Examiner* — Hoang M Nguyen
(74) *Attorney, Agent, or Firm* — Morgan, Lewis & Bockius LLP

(57) ABSTRACT

Disclosed is a pipeline connection system for a steam turbine and boiler combination that includes a boiler including a boiler heating surface and a boiler outlet header, a high-level steam turbine, and a pipeline system connected between the boiler outlet header and the high-level steam turbine. The boiler outlet header is arranged adjacent to the high-level steam turbine, and a boiler external section of pipe bundle of a pipe bank of the boiler heating surface that is connected to the boiler outlet header is arranged as an L shape comprising a horizontal section of pipe bundle and a vertical section of pipe bundle.

6 Claims, 13 Drawing Sheets

(58) Field of Classification Search
USPC ..... 60/653, 670, 677–680
See application file for complete search history.

(56) References Cited

U.S. PATENT DOCUMENTS

| | | | | | |
|---|---|---|---|---|---|
| 4,289,196 | A | * | 9/1981 | Jabsen | G21C 13/036 165/83 |
| 4,316,435 | A | * | 2/1982 | Nagamatsu | F22B 1/1815 122/235.17 |
| 2016/0322553 | A1 | | 11/2016 | Lessard | |

FOREIGN PATENT DOCUMENTS

| | | | |
|---|---|---|---|
| CN | 106051460 | A | 10/2016 |
| CN | 107091127 | A | 8/2017 |
| JP | 2014180652 | A | 9/2014 |

* cited by examiner

A direction

B direction

A direction

PIPELINE CONNECTION SYSTEM FOR STEAM TURBINE AND BOILER COMBINATION

CROSS REFERENCE TO RELATED APPLICATIONS

This application is a United States national stage application of co-pending international patent application number PCT/CN2018/083563, filed on Apr. 18, 2018 which claims the priority to China patent application No. 201710268345.9 filed on Apr. 22, 2017, disclosures of both of which are incorporated herein by reference in their entireties.

TECHNICAL FIELD

The present disclosure relates to the technical field of power generation, for example, relates to a pipeline connection system for a steam turbine and boiler combination.

BACKGROUND

With the continuing development of material technology and increasing bettering of thermal power theory, steam parameters have undergone the development process from low pressure, medium pressure, high pressure, ultrahigh pressure, subcritical pressure, supercritical pressure, all the way up to ultra-supercritical pressure. To further improve the efficiency of a thermal power generating unit, many countries have successively developed units with higher parameters. To develop units with higher parameters, however, the prices of related materials will also greatly increase, particularly for high-temperature and high-pressure steam pipelines between the steam turbine and boiler, such as a main stream pipeline, a reheating steam pipeline and the like. If the parameters of the unit are raised from the current 600° C. level to 700° C. level, the price of the materials of the 700° C. level is nearly ten times the price of the 600° C. level according to the current material prices. Especially for units adopting secondary reheating, the investment will be even larger, because compared with units adopting primary reheating a secondary reheating steam pipeline system is further added to the main high-temperature and high-pressure steam pipeline system connected between the steam turbine and the boiler in addition to the main steam pipeline system and the primary reheating steam pipeline system. Further, the long-distance high-temperature and high-pressure steam pipeline would also lead to larger pipeline pressure losses, reducing the economy of the units to a certain extent.

SUMMARY

The present disclosure provides a pipeline connection system for a steam turbine and boiler combination, which can shorten a pipeline system connected between a steam turbine and a boiler and can solve the problems of system expansion and stress, thereby ensuring the safe operation of system equipment. The present disclosure provides a pipeline connection system for a steam turbine and boiler combination. The pipeline connection system for a steam turbine and boiler combination includes a boiler including a boiler heating surface and a boiler outlet header, a high-level steam turbine, and a pipeline system connected between the boiler outlet header and the high-level steam turbine. The boiler outlet header is arranged adjacent to the high-level steam turbine, and a boiler external section of pipe bundle of a pipe bank of the boiler heating surface that is connected to the boiler outlet header is arranged as an L shape comprising a horizontal section of pipe bundle and a vertical section of pipe bundle.

In one embodiment, a final-stage reheater outlet header or a final-stage superheater outlet header in the boiler outlet header is arranged to abut against a platform of the high-level steam turbine.

In one embodiment, a final-stage reheater outlet header in the boiler outlet header is arranged at a same horizontal height as and aligned with the high-level steam turbine.

In one embodiment, a cold tensile force is preset to an interface between the high-level steam turbine and the pipeline system connected between the boiler outlet header and the high-level steam turbine.

In one embodiment, the boiler is a tower-type boiler or a it-type boiler falling under the category of a pulverized coal boiler, a circulating fluidized bed boiler or a blast furnace gas boiler.

In one embodiment, the high-level steam turbine and the boiler (viewing from the right side to the left side of the boiler) are arranged parallel to each other along a horizontal direction or arranged vertical relative to each other.

The pipeline connection system for a steam turbine and boiler combination provided by the present disclosure can achieve a short-distance direct connection of high-temperature and high-pressure steam pipelines between the steam turbine and the boiler, reduce the use amount of engineering high-temperature and high-pressure pipeline materials and pipe fittings such as elbows, and reduce the pressure loss and heat dissipation loss of the high-temperature and high-pressure steam pipeline system, thereby saving the investment in the pipeline system and improving the economy of the unit.

REFERENCE NUMERALS IN THE DRAWINGS

1—High-level steam turbine; 1'—Platform of the high-level steam turbine; 2—Final-stage reheater outlet header; 2', 2"—Steam reheating hot section pipeline; 3—Boiler frame; 4—Boiler wall; 5—Final-stage reheater; 5'—Final-stage primary reheater; 6—Vertical section pipe bundle; 7—Horizontal section pipe bundle; 8—Final-stage superheater outlet header; 8', 8"—Main steam pipeline; 9—Final-stage superheater; 10—High pressure cylinder; 11—Medium pressure cylinder; 12—Final-stage primary reheater outlet header; and 12' 12"—Primary steam reheating hot section pipeline.

DETAILED DESCRIPTION

Figure 1:
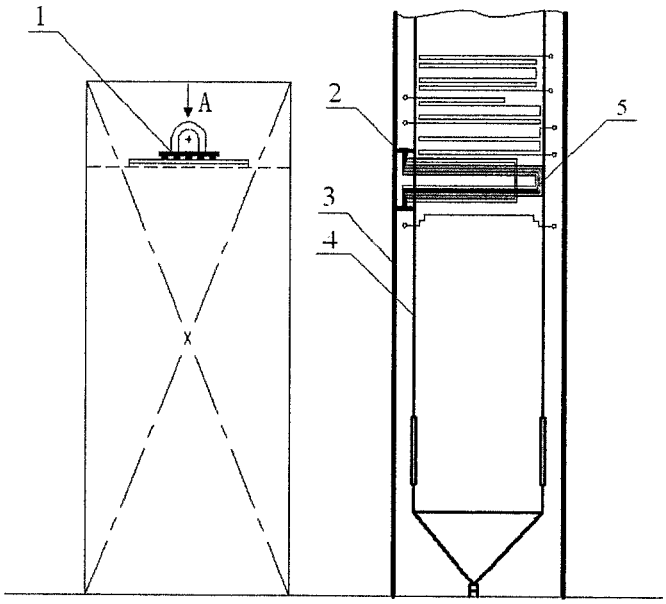
FIG. 1 is a schematic diagram illustrating a related header pipeline connection system that is connected between a tower-type boiler and a steam turbine that has been arranged on a high level.
Figure 7:
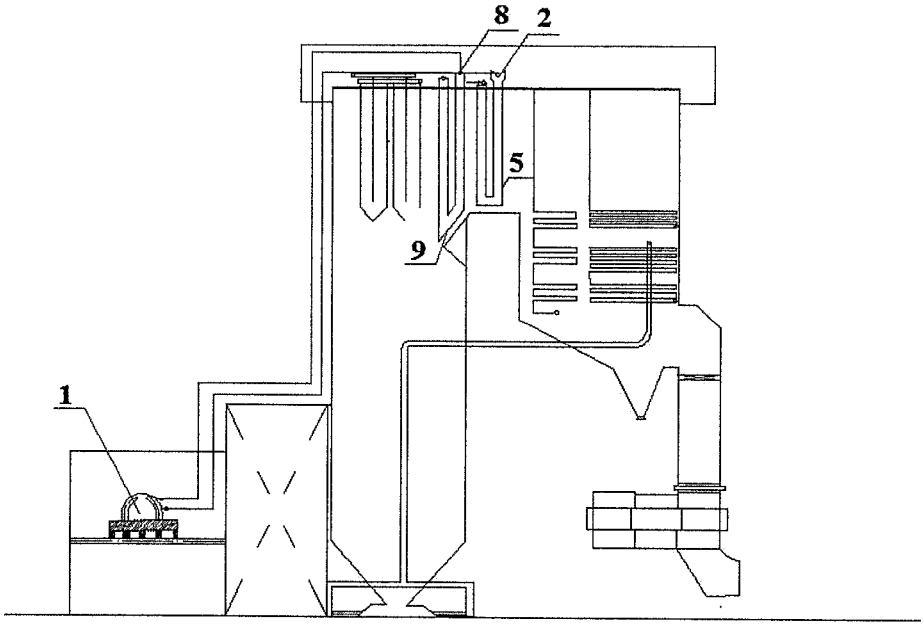
FIG. 7 is a schematic diagram illustrating a related header pipeline connection system connected between a π-type boiler and a steam turbine that has been arranged at a high level.
Figure 10:
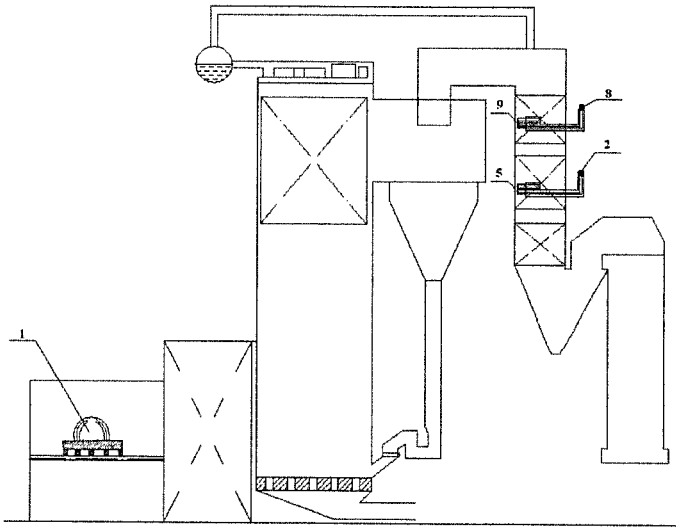
FIG. 10 is a schematic diagram illustrating a related header pipeline connection system connected between a circulating fluidized bed boiler and a steam turbine that has been arranged at a high level.

An embodiment provides a new method of arranging a steam turbine power generating unit. Compared with the conventional steam turbine power generating unit arrangement, this method arranges high- and low-level shaft systems in a staggered manner, making the high-level shaft system close to a boiler outlet header as much as possible, so that a straight line distance between the boiler outlet header (e.g., an outlet header of a final-stage superheater, a final-stage primary reheater or a final-stage secondary reheater of a boiler) and the steam turbine is greatly shortened. The related boiler outlet header, whether the boiler is a tower boiler or a π-type boiler under the category of a pulverized coal boiler, a circulating fluidized bed boiler or other boilers, is arranged according to the manner shown in the FIGS. 1, 7 and 10. That is, a hanger or a supporting platform of the boiler outlet header is directly connected to a boiler wall, and header pipe bundle of a boiler heating surface outlet wall are generally very short. However, if the boiler outlet header and the steam turbine are directly connected in a short distance by using a pipeline, since the rigidity of the pipeline is particularly high, the system expansion and stress generated due to the increase of steam temperature during the operation of the unit cannot be absorbed. Consequently, the steam turbine cannot operate normally due to excessive thrust on the steam turbine and then shuts down, and even the equipment would be damaged.

In order to solve the problems of system expansion and stress between the steam turbine and the boiler, a pipeline system for a steam turbine and boiler combination provided by an embodiment enables pipelines to bypass by setting certain elbows according to the force, moment and displacement of the steam turbine and boiler equipment and a pipeline interface until the expansion and stress generated due to the increase of the steam temperature during the operation of the unit can be accepted by the equipment. However, this conventional pipeline system connecting method fails to give play to advantages of the high- and low-level arrangement. Compared with the conventional steam turbine power generating unit arrangement, although it can greatly reduce straight pipes of the high-temperature and high-pressure steam pipeline, the system still have multiple elbows. Because the elbows have a far larger resistance coefficient than that of the straight pipes, if the cast steel elbows are adopted, whose has a small bending radius (about 1.5D) and which is expensive, about 5 to 7 times the price of the straight pipes, pressure drop of the high-temperature and high-pressure steam pipeline system with large diameter does not decrease significantly, the economy change of the unit operation is small, and the engineering investment remains enormous, which completely defeats the purpose of shortening the high-temperature and high-pressure steam pipeline through the high- and low-level arrangement.

Embodiment 1

Figure 3:
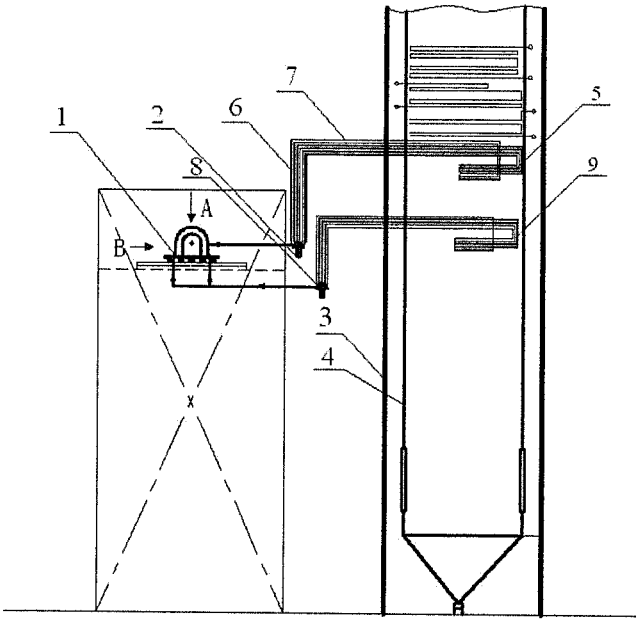
FIGS. 3, 3A and 3B are schematic diagrams illustrating a system according to Embodiment 1 of the present disclosure.

FIG. 3 shows a schematic diagram of a compact pipeline connection system for a steam turbine and boiler combination provided by this embodiment. The boiler adopts a tower boiler, and a high-level steam turbine and the boiler (viewing from the right side to the left side of the boiler) are arranged in parallel.

The pipeline connection system provided by this embodiment includes a final-stage reheater 5, a final-stage superheater 9, a final-stage reheater outlet header 2, a final-stage superheater outlet header 8, a high-level steam turbine 1 and a pipeline system connected among the final-stage reheater outlet header 2, the final-stage superheater outlet header 8 and the high-level steam turbine 1.

The final-stage reheater outlet header 2 and the final-stage superheater outlet header 8 both are adjacent to the high-level steam turbine 1. Pipe bundle between the final-stage reheater outlet header 2 and a heating surface of the final-stage reheater 5 include a horizontal section pipe bundle 7 and a vertical section pipe bundle 6. Similarly, the pipe bundle between the final-stage superheater outlet header 8 and a heating surface of the final-stage superheater 9 may also include horizontal section pipe bundle and vertical section pipe bundle.

Figure 3A:
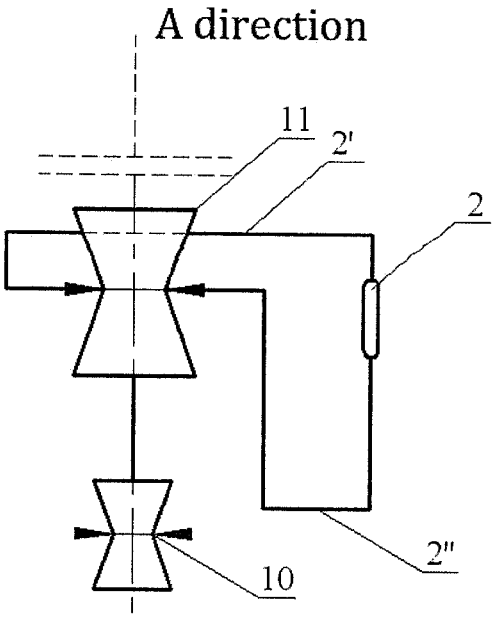
Figure 3B:
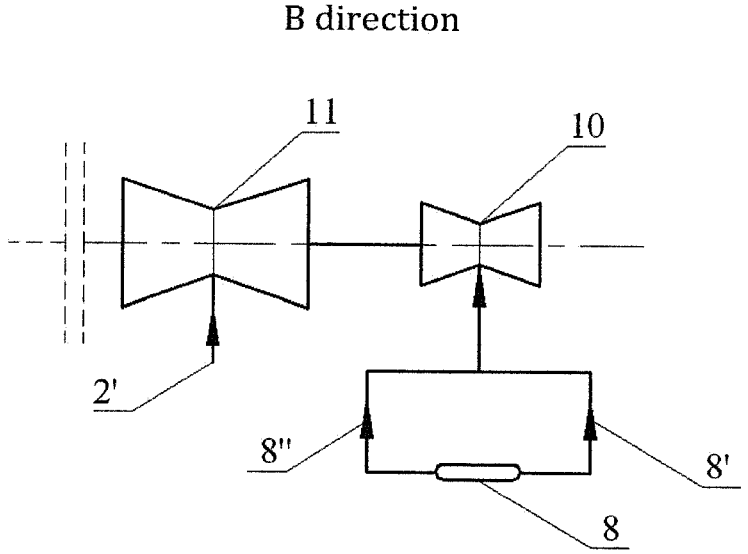

FIG. 3A is a schematic diagram of the high-level steam turbine 1 viewed in an A direction, i.e., its top view. FIG. 3B is a schematic diagram of the high-level steam turbine 1 viewed in an A direction, i.e., its top view. In this embodiment, considering that the reheating hot section pipeline has a large diameter and is more expensive compared with the main steam pipeline, the final-stage reheater outlet header 2 can be aligned with the high-level steam turbine 1 to minimize the length of the connecting pipelines 2' and 2" between them, and connecting pipelines 8' and 8" between the final-stage superheater outlet header 8 and the high-level stream turbine 1 are connected to steam inlet valves on both sides of a high pressure cylinder 10 from the lower part of the high-pressure steam turbine 1.

Through the above arrangement, according to the force, moment and displacement of the steam turbine and boiler outlet header equipment interfaces, the heating surface pipe bundle connected on the header is set to a certain length. That is, the heating surface pipe bundle in the vertical and horizontal direction are set to a certain length, such as 6 to 10 m (the specific length can be determined according to the demand of the calculation of the stress of pipeline systems between steam turbine and boiler combinations). In this way, it is ensured that the stress of all the pipe bundles, the stress at the interfaces between the pipe bundles and the header, and the stress at the contact points between the pipe bundles and a water wall lie within a permitted range.

Figure 2:
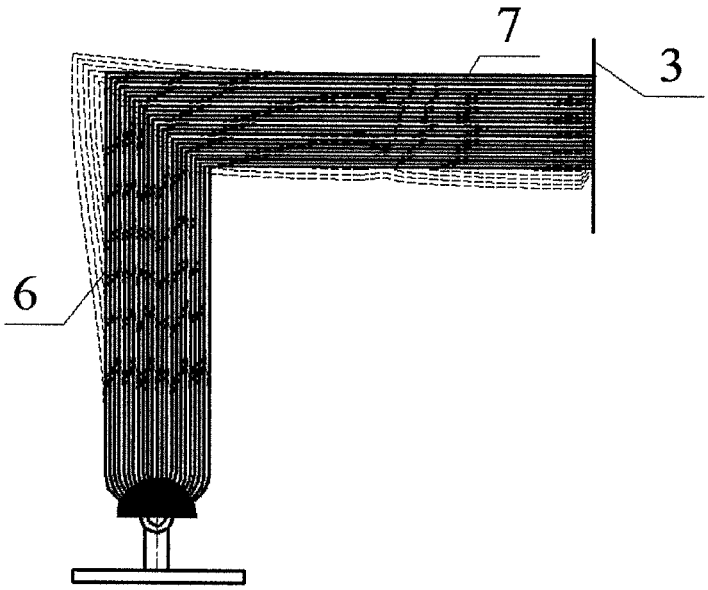
FIG. 2 is a schematic diagram illustrating heating surface pipe bundle connected to a header according to an embodiment.

FIG. 2 is a schematic diagram of heating surface pipe bundle connected on a boiler outlet header. During the operation of the boiler, with the rise of boiler temperature, the water wall will expand downwards. The downward expansion amount of the water wall is compensated by the horizontal section pipe bundle of the header, and the expansion amount of connecting pipelines of the steam turbine and boiler combination in the horizontal direction and the outward expansion amount of the water wall of the boiler are absorbed by the vertical section pipe bundle of the boiler outlet header. The heat expansion amount and the stress of the system can be absorbed by adjusting the length of horizontal section pipe bundle and vertical section pipe bundle between boiler outlet headers and heating surfaces. If the heat expansion amount and the stress of the system cannot be completely absorbed, a certain cold tensile force is preset to an interface between the steam turbine and the pipeline, so as to further reduce heat stress on the equipment interface until an allowable value of the stress calculation is reached.

The compact pipeline connection system for a steam turbine and boiler combination provided by this embodiment arranges the boiler outlet header close to the high-level stream turbine, and arranges pipe bundle between boiler outlet headers and boiler heating surfaces into a horizontal section and a vertical section with certain lengths. In this way, the length of the high-temperature and high-pressure steam pipeline (such as the main steam pipeline and the reheat steam pipeline) between the boiler outlet header and the high-level steam turbine can be designed to be the shortest. The water wall can expand downwards along with the rise of the boiler temperature during the operation of the boiler. During the operation of the boiler, with the rise of the boiler temperature, the water wall will expand downwards. For the tower boiler, the downward expansion amount of the water wall is compensated by the horizontal section pipe bundle connected with the header, and the expansion amount of connecting pipelines of the steam turbine and boiler combination in the horizontal direction and the outward expansion amount of the water wall of the boiler are absorbed by the vertical section pipe bundle connected to the boiler outlet header.

Embodiment 2

Figure 4:
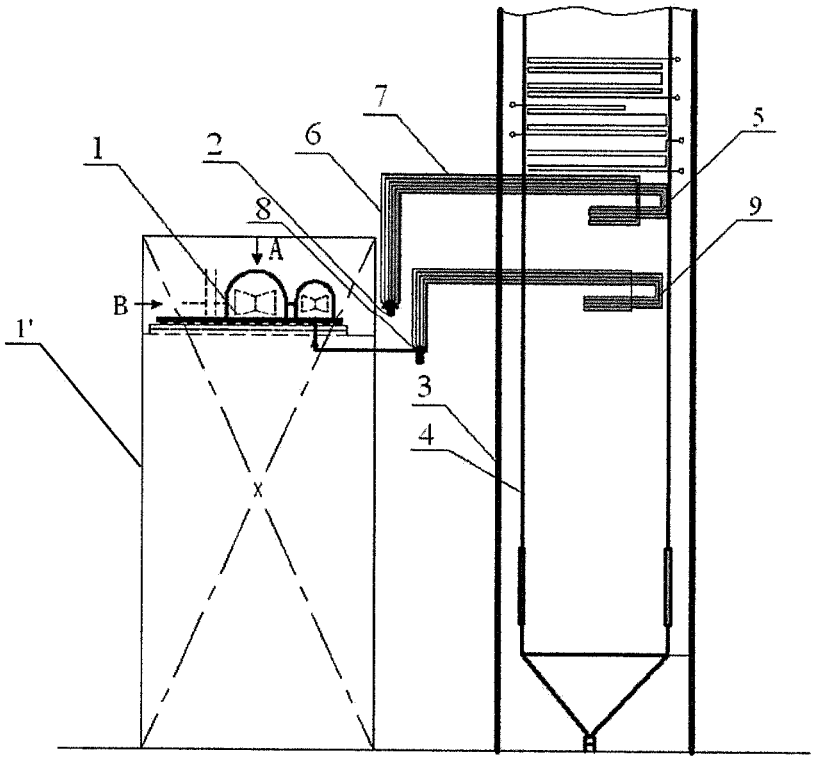
FIGS. 4, 4A and 4B are schematic diagrams illustrating a system according to Embodiment 2 of the present disclosure.

FIG. 4 shows a schematic diagram of a compact pipeline connection system for a steam turbine and boiler combination provided by this embodiment. The boiler adopts a tower boiler, and a high-level steam turbine and the boiler (viewing from the right side to the left side of the boiler) are vertically arranged in the horizontal direction.

The pipeline connection system provided by this embodiment includes a final-stage reheater 5, a final-stage superheater 9, a final-stage reheater outlet header 2, a final-stage superheater outlet header 8, a high-level steam turbine 1 and a pipeline system connected among the final-stage reheater outlet header 2, the final-stage superheater outlet header 8 and the high-level steam turbine 1.

The final-stage reheater outlet header 2 and the final-stage superheater outlet header 8 both are close to the high-level steam turbine 1. For example, the final-stage reheater outlet header 2 is arranged adjacent to a platform 1' of the high-level steam turbine. The pipe bundle between the final-stage reheater outlet header 2 and a heating surface of the final-stage reheater 5 includes a horizontal section pipe bundle 7 and a vertical section pipe bundle 6. Similarly, pipe bundle between the final-stage superheater outlet header 8 and a heating surface of the final-stage superheater 9 may also include a horizontal section pipe bundle and a vertical section pipe bundle.

Figure 4A:
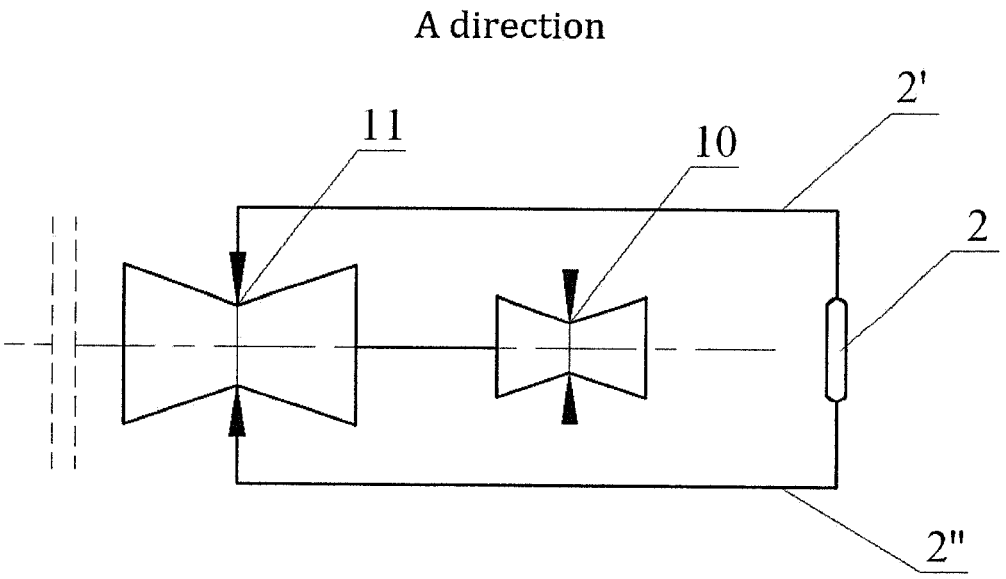
Figure 4B:
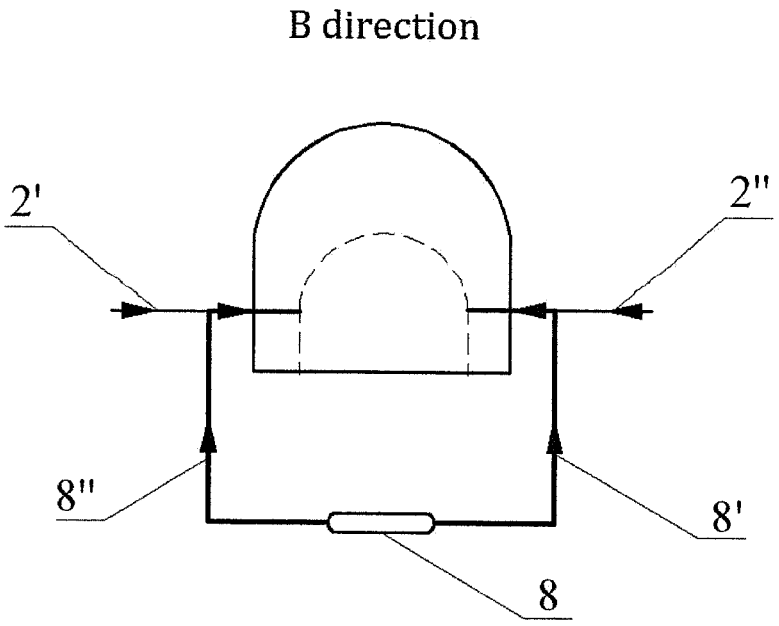

FIGS. 4A and 4B are respectively a top view and a side view of the high-level steam turbine 1. Referring to FIGS. 4A and 4B, the difference between this solution and the embodiment 1 is that the high-level steam turbine and the boiler are vertically arranged in the horizontal direction. Similarly, in this embodiment, considering that the reheating hot section pipeline has a large diameter and is more expensive compared with the main steam pipeline, the final-stage reheater outlet header 2 can be aligned with the high-level steam turbine 1 to minimize the length of the connecting pipes 2' and 2" between them, and connecting pipes 8' and 8" between the final-stage superheater outlet header 8 and the high-level stream turbine 1 are connected to steam inlet valves on both sides of a high pressure cylinder 10 from the lower part of the high-pressure steam turbine 1. The rest is the same as the embodiment 1.

Embodiment 3

Figure 5:
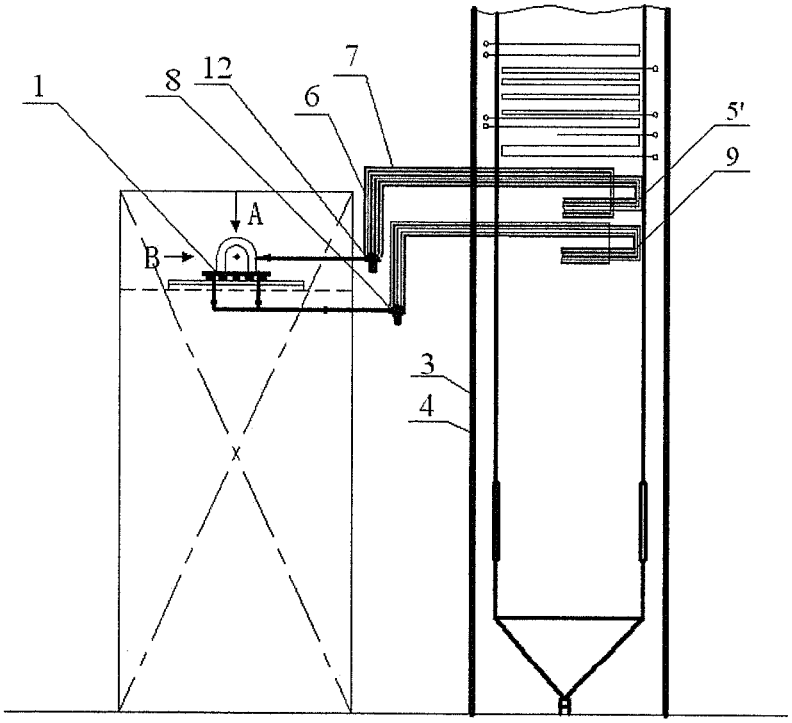
FIGS. 5, 5A and 5B are schematic diagrams illustrating a system according to Embodiment 3 of the present disclosure.

FIG. 5 shows a schematic diagram of a compactly-arranged pipeline connection system for a steam turbine and boiler combination provided by this embodiment. Using a secondary re-heating unit as an example, the boiler is a tower boiler, and a high-level steam turbine and the boiler (viewing from the right side to the left side of the boiler) are arranged in parallel. The pipeline connection system includes a final-stage superheater 9, a final-stage primary reheater 5', a final-stage superheater outlet header 8, a final-stage primary reheater outlet header 12, a high-level steam turbine 1, a main stream pipeline system connected between the final-stage superheater outlet header 8 and a high pressure cylinder 10 of the high-level steam turbine 1, and a primary reheating stream pipeline system connected between the final-stage primary reheater outlet header 12 and a medium pressure cylinder 11 of the high-level steam turbine 1.

The final-stage primary reheater outlet header 12 is close to the high-level steam turbine 1, and the pipe bundle between the final-stage primary reheater outlet header 12 and the final-stage primary reheater 5' includes a horizontal section pipe bundle 7 and a vertical section pipe bundle 6. Similarly, pipe bundle between the final-stage superheater outlet header 8 and the final-stage superheater 9 may also be arranged to include a horizontal section pipe bundle and a vertical section pipe bundle.

Figure 5A:
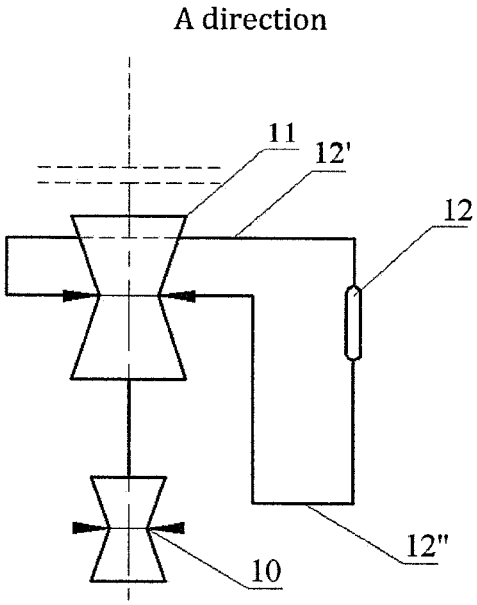
Figure 5B:
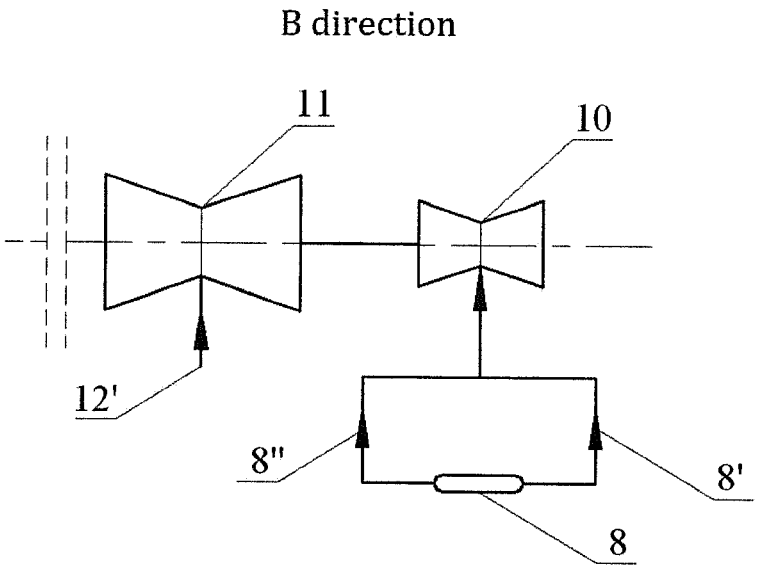

FIGS. 5A and 5B are respectively a top view and a side view of the high-level steam turbine 1. Referring to FIGS. 5A and 5B, the final-stage primary reheater outlet header is aligned with and close to the high-level steam turbine to minimize the distance between the final-stage primary reheater outlet header 12 and the high-level steam turbine 1, thereby shortening expensive primary reheating hot section pipelines 12' and 12" with large diameter, and connecting pipes 8' and 8" of the final-stage superheater outlet header 8 and the high-level stream turbine 1 are connected to steam inlet valves on both sides of the high pressure cylinder 10 from the lower part of the high-pressure steam turbine 1. The rest is the same as the embodiment 1.

Embodiment 4

Figure 6:
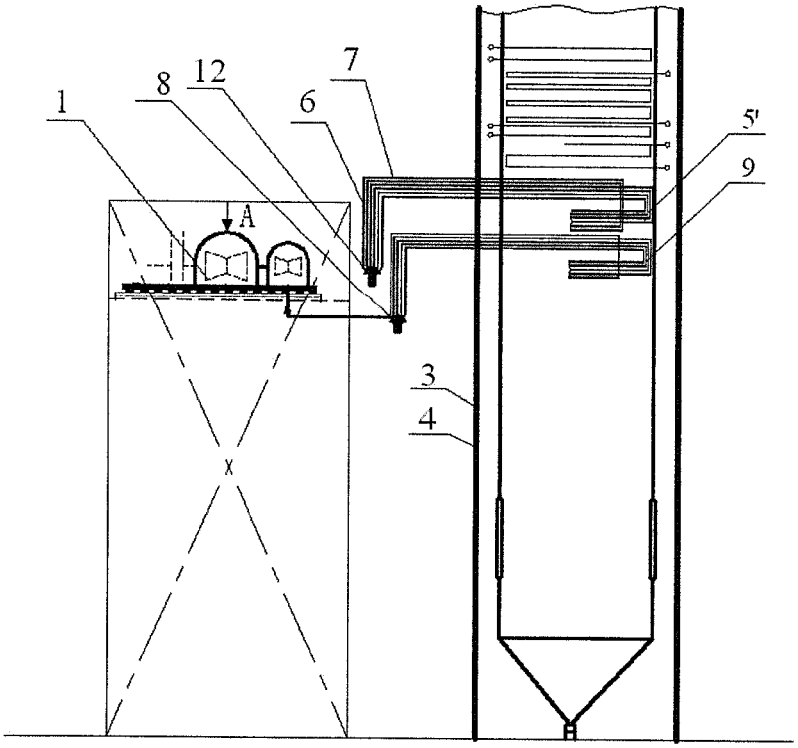
FIGS. 6, 6A and 6B are schematic diagrams illustrating a system according to Embodiment 4 of the present disclosure.

FIG. 6 shows a schematic diagram of a compactly-arranged pipeline connection system for a steam turbine and boiler combination provided by this embodiment. Using a secondary re-heating unit as an example, the boiler is a tower boiler, and a high-level steam turbine and the boiler (viewing from the right side to the left side of the boiler) are vertically arranged. The pipeline connection system includes a final-stage superheater 9, a final-stage primary reheater 5', a final-stage superheater outlet header 8, a final-stage primary reheater outlet header 12, a high-level steam turbine 1, a main stream pipeline system connected between the final-stage superheater outlet header 8 and a high pressure cylinder 10 of the high-level steam turbine 1, and a primary reheating stream pipeline system connected between the final-stage primary reheater outlet header 5' and a medium pressure cylinder 11 of the high-level steam turbine 1.

The final-stage primary reheater outlet header 12 is close to the high-level steam turbine 1, and the pipe bundle between the final-stage primary reheater outlet header 12 and the final-stage primary reheater 5' includes a horizontal section pipe bundle 7 and a vertical section pipe bundle 6. Similarly, the pipe bundle between the final-stage superheater outlet header 8 and the final-stage superheater 9 may also be arranged to include horizontal section pipe bundle and vertical section pipe bundle.

Figure 6A:
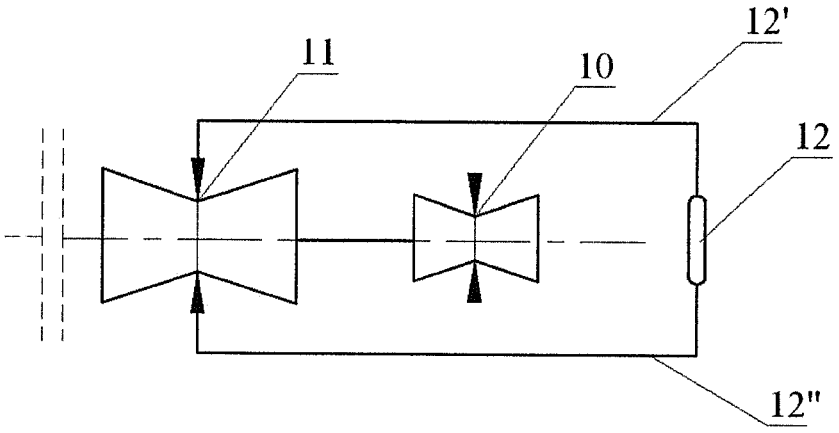
Figure 6B:
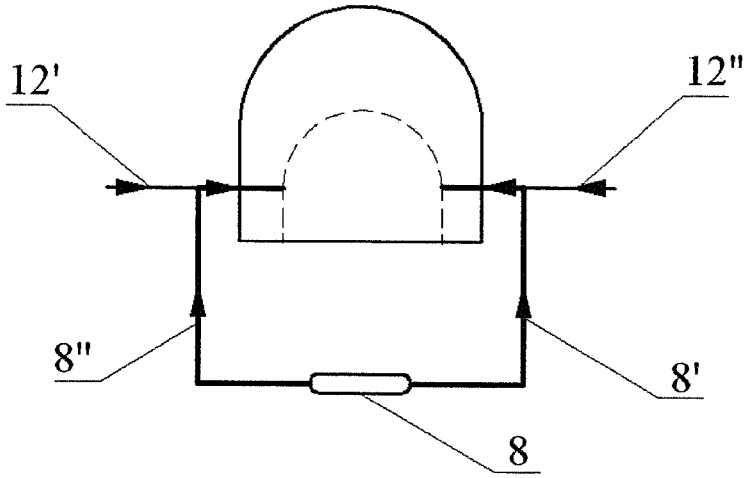

FIGS. 6A and 6B are respectively a top view and a side view of the high-level steam turbine 1. Referring to FIGS. 6A and 6B, the final-stage primary reheater outlet header is aligned with and close to the high-level steam turbine to minimize the distance between the final-stage primary reheater outlet header 12 and the high-level steam turbine 1, thereby greatly shortening expensive primary reheating hot section pipelines 12' and 12" with large diameter, and connecting pipes 8' and 8" of the final-stage superheater outlet header 8 and the high-level stream turbine 1 are connected to steam inlet valves on both sides of the high pressure cylinder 10 from the lower part of the high-pressure steam turbine 1. The rest is the same as the embodiment 1.

Embodiment 5

Figure 8:
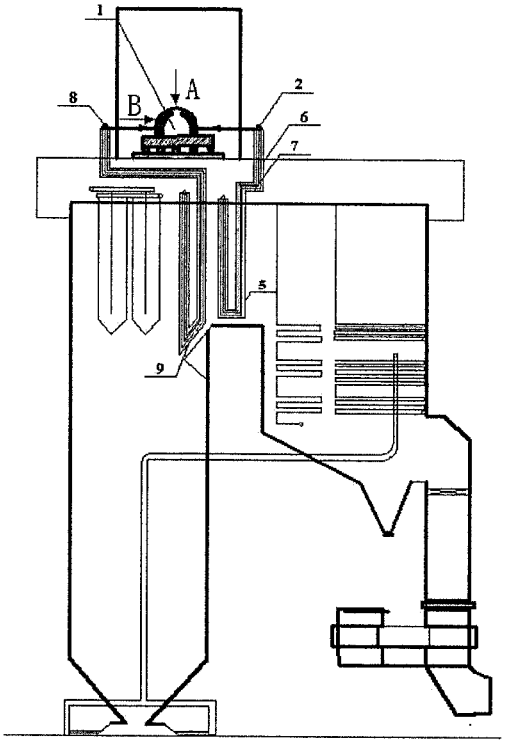
FIGS. 8, 8A and 8B are schematic diagrams illustrating a system according to Embodiment 5 of the present disclosure.

FIG. 8 shows a schematic diagram of a compactly-arranged pipeline connection system for a steam turbine and boiler combination provided by this embodiment. The boiler adopts a π-type boiler, a high-level steam turbine is arranged on the top of the boiler, and the high-level steam turbine and the boiler (viewing from the right to the left of the boiler) are arranged in the parallel direction.

The pipeline connection system provided by this embodiment includes a final-stage reheater 5, a final-stage superheater 9, a final-stage reheater outlet header 2, a final-stage superheater outlet header 8, a high-level steam turbine 1 and a pipeline system connected among the final-stage reheater outlet header 2, the final-stage superheater outlet header 8 and the high-level steam turbine 1.

The final-stage reheater outlet header 2 and the final-stage superheater outlet header 8 both are close to the high-level steam turbine 1. The pipe bundle between the final-stage reheater outlet header 2 and a heating surface of the final-stage reheater 5 includes a horizontal section pipe bundle 7 and a vertical section pipe bundle 6. Similarly, the pipe bundle between the final-stage superheater outlet header 8 and a heating surface of the final-stage superheater 9 may also be arrange to include a horizontal section pipe bundle and a vertical section pipe bundle.

Figure 8A:
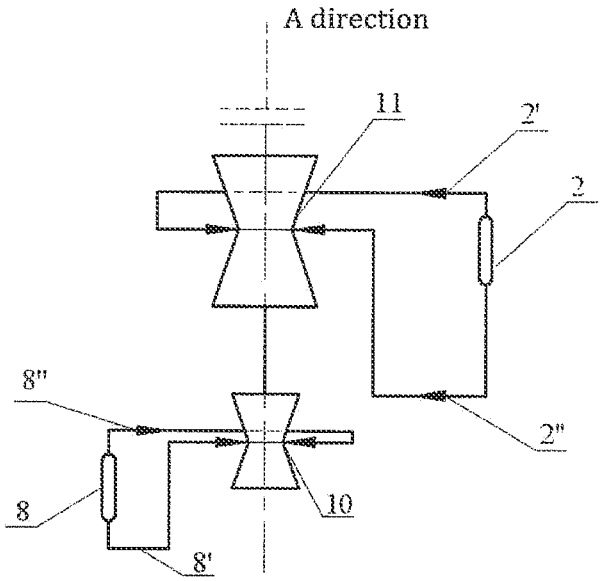
Figure 8B:
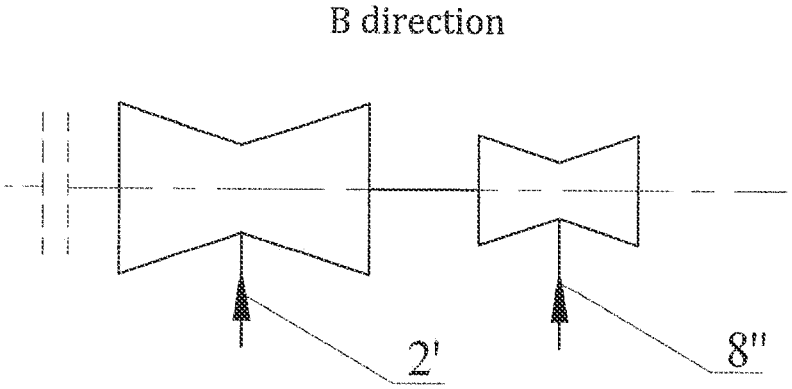

FIGS. 8A and 8B are respectively a top view and a side view of the high-level steam turbine 1. As shown in FIGS. 8A and 8B, the position of the final-stage reheater outlet header 2 and the final-stage superheater outlet header 8 needs to be close to the high-level steam turbine as much as possible to save the high-temperature and high-pressure steam pipeline with large diameter, the length of the pipe bundle (including the horizontal section pipe bundle and the vertical section pipe bundle) needs to meet requirements of absorbing system expansion, and the rest is the same as the embodiment 1.

Embodiment 6

Figure 9:
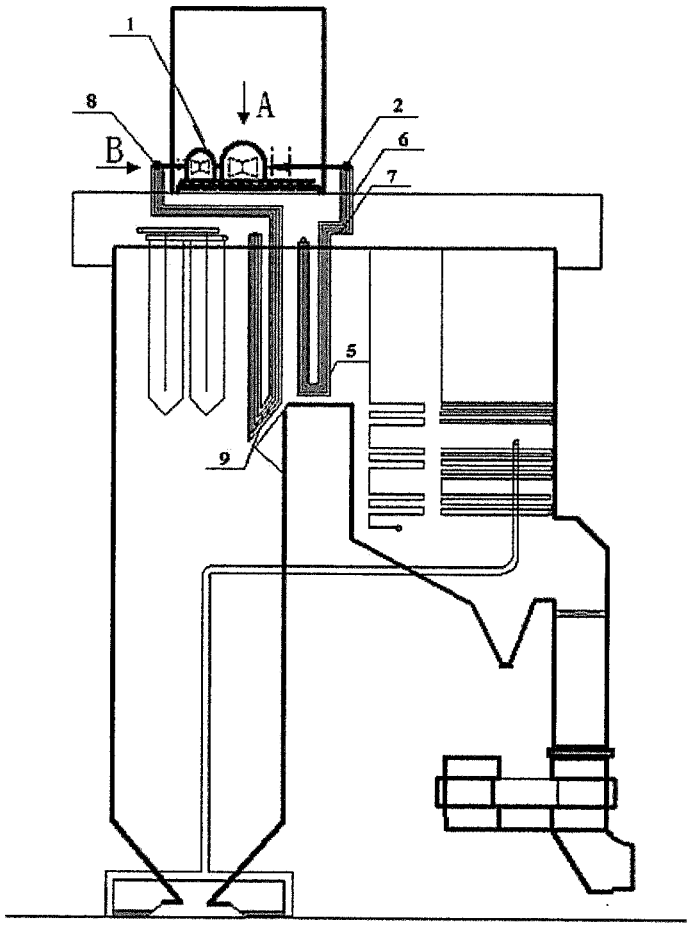
FIGS. 9 and 9A are schematic diagrams illustrating a system according to Embodiment 6 of the present disclosure.

FIG. 9 shows a schematic diagram of a compactly-arranged pipeline connection system for a steam turbine and boiler combination provided by this embodiment. The boiler adopts a π-type boiler, a high-level steam turbine is arranged on the top of the boiler, and the high-level steam turbine and the boiler (viewing from the right side to the left side of the boiler) are arranged in the vertical direction.

The pipeline connection system provided by this embodiment includes a final-stage reheater 5, a final-stage superheater 9, a final-stage reheater outlet header 2, a final-stage superheater outlet header 8, a high-level steam turbine 1 and a pipeline system connected among the final-stage reheater outlet header 2, the final-stage superheater outlet header 8 and the high-level steam turbine 1.

The final-stage reheater outlet header 2 and the final-stage superheater outlet header 8 both are close to the high-level steam turbine 1. The pipe bundle between the final-stage reheater outlet header 2 and a heating surface of the final-stage reheater 5 includes horizontal section pipe bundle 7 and vertical section pipe bundle 6. Similarly, pipe bundle between the final-stage superheater outlet header 8 and a heating surface of the final-stage superheater 9 may also be arrange to include horizontal section pipe bundle and vertical section pipe bundle.

Figure 9A:
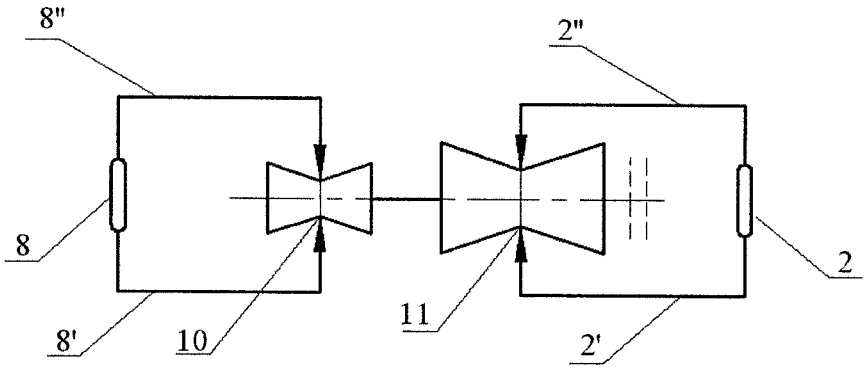

FIG. 9A is a top view of the high-level steam turbine 1. The position of the final-stage reheater outlet header 2 and the final-stage superheater outlet header 8 needs to be close to the high-level steam turbine as much as possible to save the high-temperature and high-pressure steam pipeline with large diameter, and the length of the pipe bundle (including the horizontal section pipe bundle and the vertical section pipe bundle) needs to meet requirements of absorbing system expansion. The difference between this embodiment and the embodiment 5 is that the direction of the high-level steam turbine and the boiler is the vertical direction.

Embodiment 7

Figure 11:
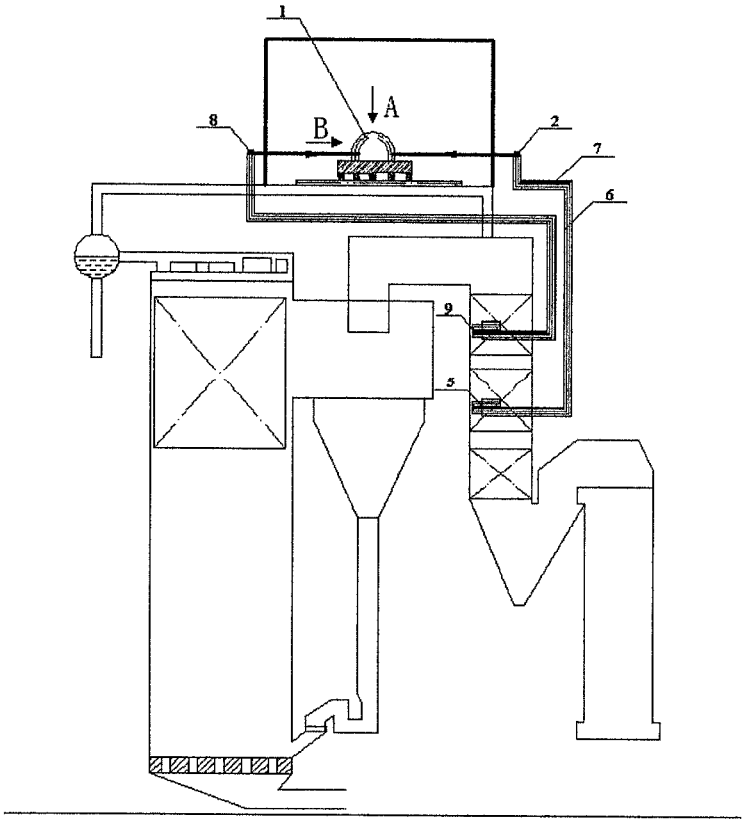
FIGS. 11, 11A and 11B are schematic diagrams illustrating a system according to Embodiment 7 of the present disclosure.

FIG. 11 shows a schematic diagram of a compactly-arranged pipeline connection system for a steam turbine and boiler combination provided by this embodiment. The boiler adopts a circulating fluidized bed boiler, a high-level steam turbine is arranged on top of the boiler, and the high-level steam turbine and the boiler (viewing from the right side to the left side of the boiler) are arranged in a parallel direction.

The pipeline connection system provided by this embodiment includes a final-stage reheater 5, a final-stage superheater 9, a final-stage reheater outlet header 2, a final-stage superheater outlet header 8, a high-level steam turbine 1 and a pipeline system connected among the final-stage reheater outlet header 2, the final-stage superheater outlet header 8 and the high-level steam turbine 1.

The final-stage reheater outlet header 2 and the final-stage superheater outlet header 8 both are close to the high-level steam turbine 1. The pipe bundle between the final-stage reheater outlet header 2 and a heating surface of the final-stage reheater 5 includes a horizontal section pipe bundle 7 and a vertical section pipe bundle 6. Similarly, the pipe bundle between the final-stage superheater outlet header 8 and a heating surface of the final-stage superheater 9 may also be arrange to include a horizontal section pipe bundle and a vertical section pipe bundle.

Figure 11A:
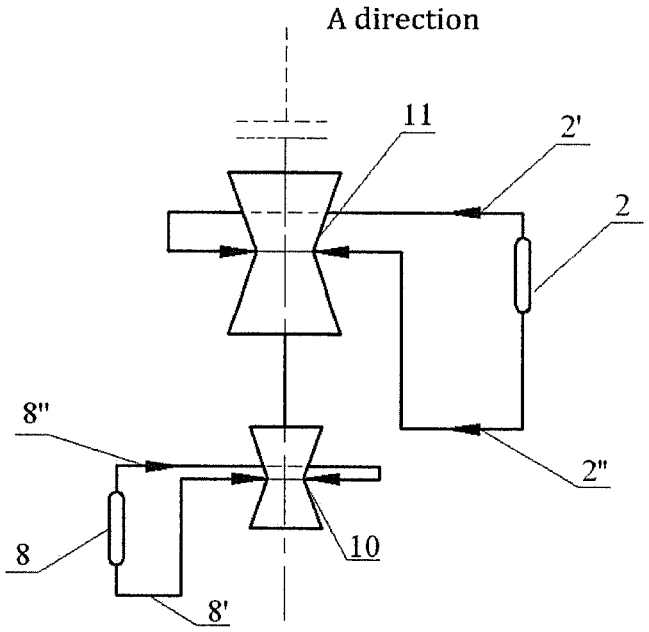
Figure 11B:
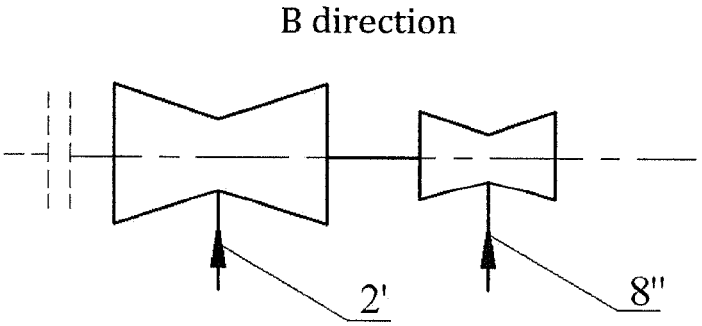

FIGS. 11A and 11B are respectively a top view and a side view of the high-level steam turbine 1. Referring to FIGS. 11A and 11B, the position of the final-stage reheater outlet header 2 and the final-stage superheater outlet header 8 needs to be close to the high-level steam turbine as much as possible to save the high-temperature and high-pressure steam pipeline with large diameter, and the length of the pipe bundle (including the horizontal section pipe bundle and the vertical section pipe bundle) needs to meet requirements of absorbing system expansion.

Embodiment 8

Figure 12:
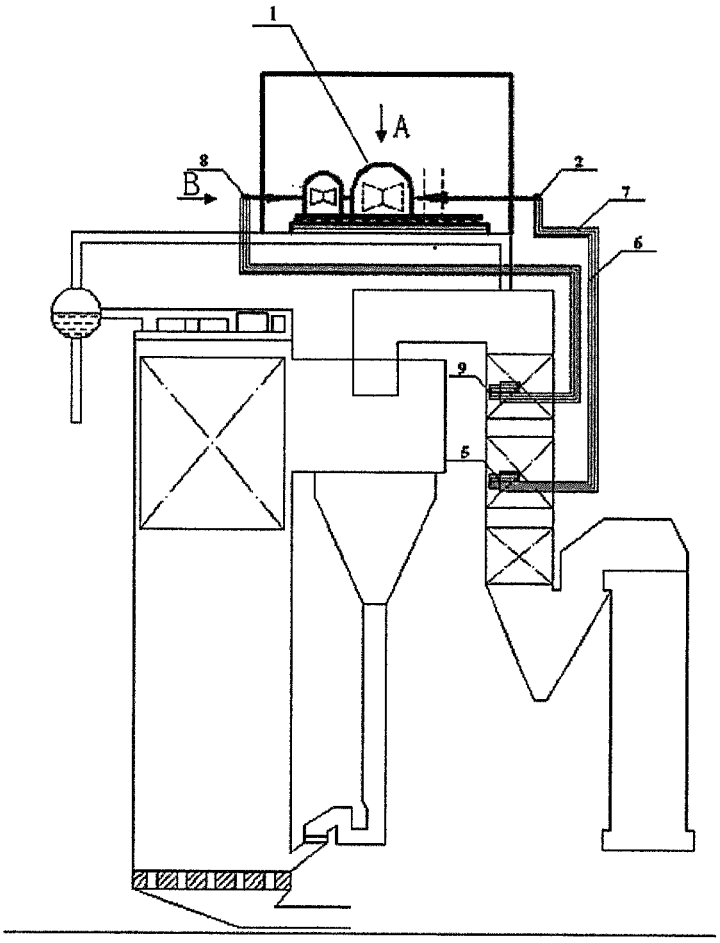
FIGS. 12 and 12A are schematic diagrams illustrating a system according to Embodiment 8 of the present disclosure.

FIG. 12 shows a schematic diagram of a compactly-arranged pipeline connection system for a steam turbine and boiler combination provided by this embodiment. The boiler adopts a circulating fluidized bed boiler, a high-level steam turbine is arranged on top of the boiler, and the high-level steam turbine and the boiler (viewing from the right side to the left side of the boiler) are arranged in the vertical direction.

The pipeline connection system provided by this embodiment includes a final-stage reheater 5, a final-stage superheater 9, a final-stage reheater outlet header 2, a final-stage superheater outlet header 8, a high-level steam turbine 1 and a pipeline system connected among the final-stage reheater outlet header 2, the final-stage superheater outlet header 8 and the high-level steam turbine 1.

The final-stage reheater outlet header 2 and the final-stage superheater outlet header 8 both are close to the high-level steam turbine 1. The pipe bundle between the final-stage reheater outlet header 2 and a heating surface of the final-stage reheater 5 includes a horizontal section pipe bundle 7 and a vertical section pipe bundle 6. Similarly, the pipe bundle between the final-stage superheater outlet header 8 and a heating surface of the final-stage superheater 9 may also be arrange to include a horizontal section pipe bundle and a vertical section pipe bundle.

Figure 12A:
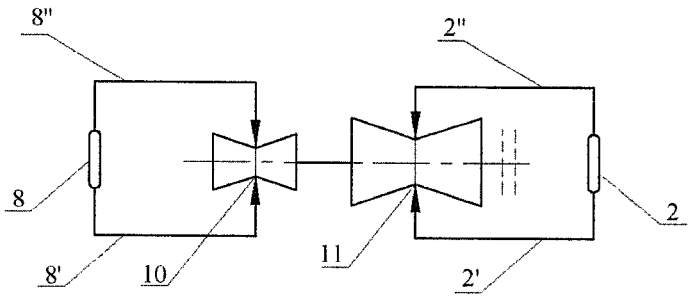

FIG. 12A is a top view of the high-level steam turbine 1. The position of the final-stage reheater outlet header 2 and the final-stage superheater outlet header 8 needs to be close to the high-level steam turbine as much as possible to save the high-temperature and high-pressure steam pipeline with large diameter, and the length of the pipe bundle (including the horizontal section pipe bundle and the vertical section pipe bundle) needs to meet requirements of absorbing system expansion.

The pipeline system provided by the present disclosure breaks through the traditional manner of connecting pipelines between the steam turbine and boiler combinations in a bypass manner to meet the requirements of the pipeline system stress calculation. The boiler outlet headers are attached to the steam turbine, so that the thermal expansion and the thermal stress of the system between the steam turbine and boiler combinations are absorbed by the pipe bundle connected to the boiler outlet headers, achieving the short-distance direct connection (without bypass) of the high-temperature and high-pressure steam pipelines between the steam turbine and boiler combinations. In this way, the advantages of high- and low-level arrangement can be fully exploited, thereby breaking through the problem of the pipeline system stress calculation, the use amount of engineering high-temperature and high-pressure pipeline materials and pipe fittings such as elbows is substantially reduced, and the pressure loss and the heat dissipation loss of the high-temperature and high-pressure steam pipeline system are reduced, thereby saving the investment in the pipeline system and improving the economy of the unit.

The pipeline connection system for a steam turbine and boiler combination provided by the present disclosure can achieve a short-distance direct connection of high-temperature and high-pressure steam pipelines between the steam turbine and the boiler, reduce the use amount of engineering high-temperature and high-pressure pipeline materials and pipe fittings such as elbows, and reduce the pressure loss and heat dissipation loss of the high-temperature and high-pressure steam pipeline system, thereby saving the investment in the pipeline system and improving the economy of the unit.

What is claimed is:

1. A pipeline connection system for a steam turbine and boiler combination, comprising:

a boiler, comprising a boiler heating surface and a boiler outlet header;

a high-level steam turbine; and a pipeline system connected between the boiler outlet header and the high-level steam turbine;

wherein the boiler outlet header is arranged adjacent to the high-level steam turbine, and a boiler external section of pipe bundle of a pipe bank of the boiler heating surface that is connected to the boiler outlet header is arranged as an L shape comprising a horizontal section of pipe bundle extending into the boiler and a vertical section of pipe bundle connected to the boiler outlet header.

2. The pipeline connection system of claim 1, wherein a final-stage reheater outlet header or a final-stage superheater outlet header in the boiler outlet header is arranged to abut against a platform of the high-level steam turbine.

3. The pipeline connection system of claim 1, wherein a final-stage reheater outlet header in the boiler outlet header is arranged at a same horizontal height as and aligned with the high-level steam turbine.

4. The pipeline connection system of claim 1, wherein a cold tensile force is preset to an interface between the high-level steam turbine and the pipeline system connected between the boiler outlet header and the high-level steam turbine.

5. The pipeline connection system of claim 1, wherein the boiler is a tower-type boiler or a π-type boiler falling under the category of a pulverized coal boiler, a circulating fluidized bed boiler, or a blast furnace gas boiler.

6. The pipeline connection system of claim 1, wherein the high-level steam turbine and the boiler are arranged parallel to each other along a horizontal direction or arranged vertical relative to each other.

* * * * *